US012440716B2

(12) United States Patent
Mihelcic

(10) Patent No.: US 12,440,716 B2
(45) Date of Patent: Oct. 14, 2025

(54) WEIGHTLIFTING ASSISTANCE DEVICE WITH SAFETY FEATURE

(71) Applicant: IM DEVELOPMENT d.o.o., Rijeka (HR)

(72) Inventor: Ivan Mihelcic, Kostrena (HR)

(73) Assignee: IM DEVELOPMENT D.O.O., Rijeka (HR)

( * ) Notice: Subject to any disclaimer, the term of this patent is extended or adjusted under 35 U.S.C. 154(b) by 121 days.

(21) Appl. No.: 18/533,630

(22) Filed: Dec. 8, 2023

(65) Prior Publication Data

US 2024/0278062 A1 Aug. 22, 2024
US 2025/0032841 A2 Jan. 30, 2025

Related U.S. Application Data

(63) Continuation of application No. PCT/EP2021/065539, filed on Jun. 9, 2021.

(51) Int. Cl.
*A63B 21/078* (2006.01)
*A63B 21/00* (2006.01)

(52) U.S. Cl.
CPC .... *A63B 21/0783* (2015.10); *A63B 21/00181* (2013.01)

(58) Field of Classification Search
CPC ..... A63B 21/0783; A63B 21/00181
See application file for complete search history.

(56) References Cited

U.S. PATENT DOCUMENTS 6,086,520 A * 7/2000 Rodriquez ..... A63B 21/4029 482/104
9,248,335 B2 * 2/2016 Reyes ..... A63B 21/078
10,881,894 B2 1/2021 Davis
11,918,843 B2 * 3/2024 Sorin ..... A63B 21/0783
12,239,873 B2 * 3/2025 Rees ..... A63B 21/4029
2008/0004165 A1 * 1/2008 Brawner ..... A63B 21/0783 482/104

(Continued)

FOREIGN PATENT DOCUMENTS

EP 2306199 A1 4/2011
EP 3011335 B1 7/2018

(Continued)

OTHER PUBLICATIONS

International Search Report and Written Opinion mailed on Mar. 9, 2022, received for PCT Application PCT/EP2021/065539, filed on Jun. 9, 2021, 10 pages.

(Continued)

*Primary Examiner* — Zachary T Moore
(74) *Attorney, Agent, or Firm* — XSENSUS LLP

(57) ABSTRACT

A weightlifting assistance device for mounting on a rack, where the device weightlifting assistance 10 can comprise a base, a connector, a top, fixation frames, a fixer or coupler to affix or couple the weightlifting assistance device to the rack, a locking gas spring, and one or more guides and corresponding bushing. The top, which can be movable, can be equipped with slidable inserted barbell holder fixed thereto via a dedicated lock or locks. The force exerted to the barbell holder can unlock previously stored mechanical energy within the locking gas spring and can enable the weightlifting assistance device to produce counterforce to the applied outer force.

20 Claims, 7 Drawing Sheets

(56) References Cited

U.S. PATENT DOCUMENTS

| | | | | |
|---|---|---|---|---|
| 2014/0256517 | A1* | 9/2014 | Poppinga | A63B 21/078 482/104 |
| 2023/0241446 | A1* | 8/2023 | Rees | A63B 21/0783 482/104 |

FOREIGN PATENT DOCUMENTS

| | | | |
|---|---|---|---|
| EP | 3482207 | B1 | 3/2023 |
| WO | 2022/207537 | A2 | 10/2022 |

OTHER PUBLICATIONS

Pucić et al., "High Throughput Isolation and Glycosylation Analysis of IgG—Variability and Heritability of the IgG Glycome in Three Isolated Human Populations", Technological Innovations and Resources, Molecular & Cellular Proteomics, vol. 10, No. 10, 2011, pp. 1-15.

* cited by examiner

WEIGHTLIFTING ASSISTANCE DEVICE WITH SAFETY FEATURE

CROSS-REFERENCE TO RELATED APPLICATION

The present application is a continuation of International Application No. PCT/EP2021/065539, filed Jun. 9, 2021, which is incorporated herein by reference in its entirety.

TECHNICAL FIELD

The present disclosure is directed to a weightlifting assistance device, with safety feature implemented to the same device, and systems, methods, and components thereof.

BACKGROUND

Everyone who has lifted weights has been in this position to need some help from the assistant, e.g., the spotter. Getting pinned or stuck under a barbell does not only happen to inexperienced lifters. Even the most skilled lifters have to face the reality that, when lifting a loaded barbell, many things may go wrong very fast. Self-overestimation combined with fatigue, muscle cramps, loss of balance, or the bar slipping out of the lifter's hands are always part of the inherent risks. Therefore, skilled and experienced spotters which are fully focused on assisting the athlete are certainly the best solution for the observed problems. However, such persons are not available in every moment.

U.S. Pat. No. 4,249,726 for EXERCISE BENCH SAFETY DEVICE, filed in the name of F. Reginald, describes a safety device for use in conjunction with a bench press. In the '726 solution a pair of arms, which are controllable by the exerciser via the foot pedal that triggers motor, is connected with the hydraulic cylinder to rise the frame and the corresponding arms. The '726 solution is understood not to be separable from the used rack and requires a foot activation.

U.S. Pat. No. 4,799,672 for POWERLIFT COMPETITION SAFETY DEVICE, filed in the name of W. L. Barett, describes a weightlifting apparatus operable to support a barbell. The solution of '672 comprises a pair of spaced-apart, substantially parallel vertical support members, where each support member bears synchronously and selectively movable, horizontally projecting spotting arms. Each spotting arm is coupled with a rod and cylinder assembly and each assembly is fluid activated for synchronous movement of said spotting arms. An actuator or switch is provided for actuating said assemblies. The '672 solution is not understood to be separable from the used rack and is understood to require, at least in the described preferred embodiment, a foot activation.

U.S. Pat. No. 5,653,666 for NEGATIVE RESISTANCE WEIGHTLIFTING APPARATUS, filed in the name of J. T. Pantoleon, describes a hydraulic operated assistance device that is activated via the hand switches.

U.S. Pat. No. 6,086,520 for WEIGHT LIFTING SAFETY SYSTEM EMPLOYING CONSTANT FORCE SPRING, filed in the name of A. Rodriquez, describes a safety system that can be used as paired device, where each device is positioned to support the barbell, if necessary, close to the athlete's arms. The disclosed system uses a jack screw, powered by the electric motor, that is foot activated. An external power supply and the omnipresence of the foot activation, i.e., an absence of the sensors located close to used barbells, may be required. Furthermore, it seems that the '520 solution may be intended only for floor use, without flexibility to be fixed to any other rack.

U.S. Pat. No. 6,746,379 for SELF-SPOTTING SAFETY BENCH PRESS, filed in the name of W. M. BRAWNER, describes two-cylinder devices, where said cylinders engage protective arms. The cylinders in '379 are powered from the central hydraulic accumulator and the corresponding hydraulic lines, and again is foot activated.

US patent application US 2007/203003 A1 for SELF SPOTTING BARBELL PRESS, filed in the name of W. M. Brawner, describes yet another foot operated self-spotting barbell press. In the preferred embodiment, the '003 solution describes transmitting the mechanical energy from one hydraulic cylinder and the corresponding pulley-strings system to the arms, that renders the system complicated. The solution '003 is not understood to be separable from the used rack and is understood to require, at least in a preferred embodiment, a foot activation.

U.S. Pat. No. 7,591,771 for APPARATUS AND METHOD FOR FACILITATING THE SAFE LIFTING OF FREE WEIGHTS, filed in the name of J. N. BOONE et al., describes fully automated self-spotting device. The device has two hydraulic cylinders, disposed within the dedicated rack, with the set of sensors disposed within the rack to spot the velocity-related parameters and the data processing means to control said cylinders. Furthermore, the '771 device is understood to require substantial power to operate, is not understood to allow the lifting assistance, and is not understood to be an easy affordable exercising device for the home use.

SUMMARY

According to an aspect, one or more weightlifting assistance devices each configured to be mounted on a rack can be provided or implemented. Each weightlifting assistance device can comprise: a base, a connector, a top configured to be movable, fixation frames, a coupler to removably couple the weightlifting assistance device to the rack, and a gas spring, wherein one or more linear guide bushings are locked into the base on one side, and extend parallelly toward the connector, where all guide bushings end; each linear guide, which emerges from the corresponding liner guide bushing, ends connected to the top, allowing the top to travel from the connector upward for a travel path defined by the gas spring; the bottom fixation frame extends from the base and the top fixation frame extends from the connector, where both the bottom and top fixation frames end into the coupler and space apart all linear guides from the coupler, and where the top is equipped with a barbell holder, allowing the barbell holder to be locked within the top at a desired position by using a lock; the gas spring is a locking gas spring that is formed from an outer cylinder, a piston rod, and a release pin configured to activate a valve mechanism via force exerted to the release pin, and the force being transmitted via a valve actuator towards the valve to lock or unlock the locking gas spring; the outer cylinder of the gas spring is nested within the base and the connector in a manner that the piston rod and a socket mounted to the piston rod, are loosely inserted into the top in a way that the release pin, positioned within the piston rod top, is in direct mechanical contact with the top and the barbell holder inserted thereinto; and under a condition that the outer force is exerted to the barbell holder in the base direction, the outer force unlocks previously stored mechanical energy within the locking gas spring and enables the weightlifting assistance device to produce counterforce by extending the piston rod and the top with the barbell holder attached thereto in the opposite direction of the applied outer force for times during which the outer force is exerted, otherwise in absence of the outer force the locking gas spring is locked.

DESCRIPTION OF FIGURES

FIG. 5A shows exemplary activation, and FIGS. 5B and 5C show exemplary releasing of the mechanical energy stored into the weightlifting assistance device, that produces counterforce. FIG. 5D depicts just another side view of the same weightlifting assistance device which is already depicted via FIG. 5C.

DETAILED DESCRIPTION

Figure 1:
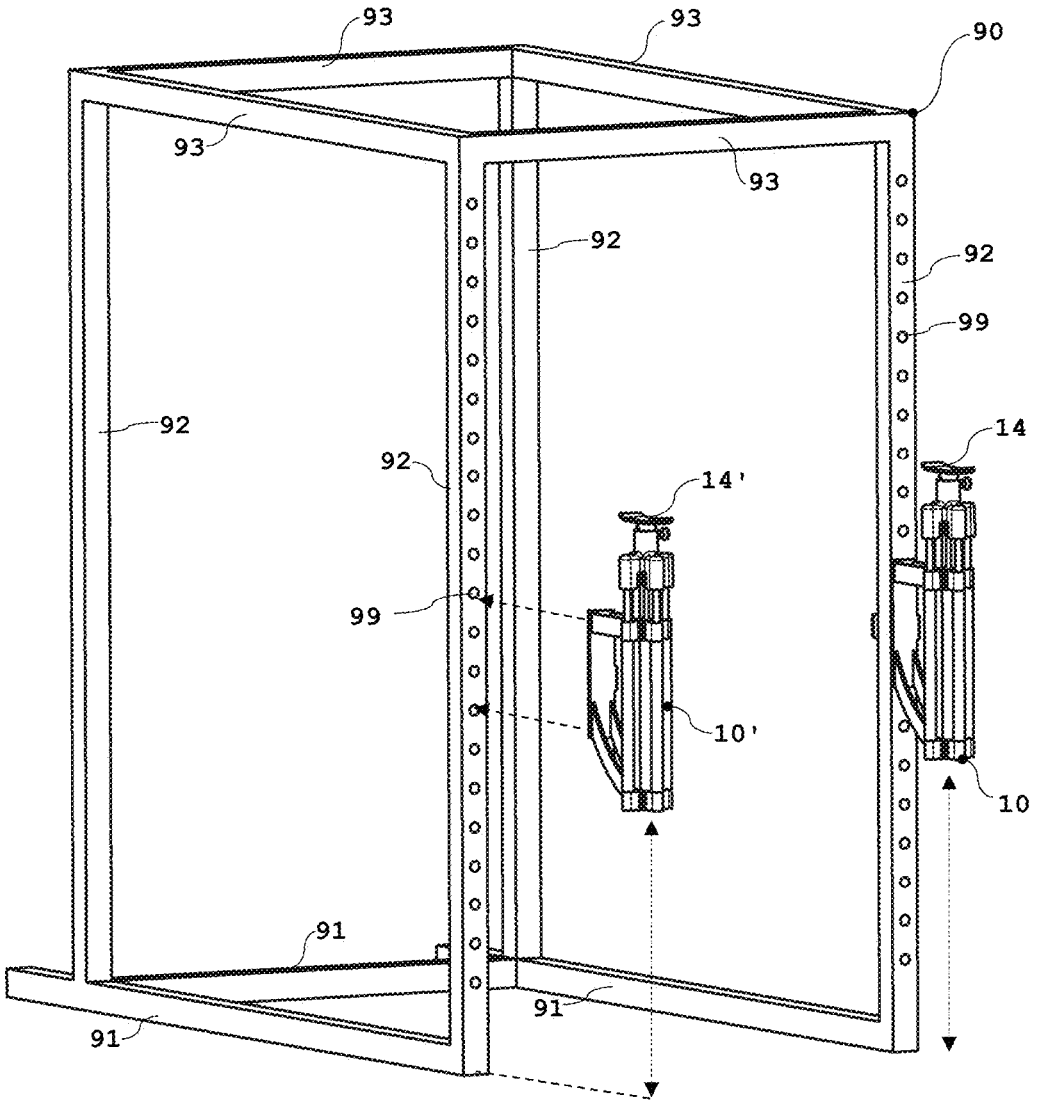
FIG. 1 depicts a squat rack with one weightlifting assistance device according to one or more embodiments of the present disclosure attached thereto and another said device that may be installed.

As noted above, the present disclosure is directed to a weightlifting assistance device, with safety feature implemented to the same device, and systems, methods, and components thereof. The corresponding technical field is the field of exercising apparatus for developing or strengthening the muscles or joints of the body by working against a counterforce, with or without measuring devices. More precisely, the technical field is oriented to devices used during user-manipulated weights, in particular devices for bench press exercises or similar designed for assistance features acting on the barbell and safety features as well.

One technical problem solved by one or more embodiments of the present can be that the weightlifting assistance device (s) can be applicable to any squat racks or similar weightlifting frame as a self-spotting assistance and safety device. According to one or more embodiments, such weightlifting assistance device (s) may not be regarded as being a part of the squat rack mechanism, or similar device, and do not cooperate mechanically with it, except that such weightlifting assistance device(s) can be removably fixed with the squat rack mechanism or similar device.

Another technical problem solved by one or more embodiments of the present disclosure can be that the weightlifting assistance device (s) can be entirely structurally integrated and may not require any outer energy source, i.e., an electric or a hydraulic power supply during operation.

Additionally or alternatively, weightlifting assistance devices according to one or more embodiments of the present disclosure can be used in pair (s), where each of the pair(s) of weightlifting assistance devices can prevent a barbell to simply fall on the weightlifter and/or to help the weightlifter to finish the series of exercises by compensating the part of the weights via the energy stored within the said device. Both actions can be performed by an activation mechanism designed to be activated solely by the barbell force on each paired device, by which the mechanical energy already accumulated in the devices are used. So, the activation can be regarded as relatively simple, according to one or more embodiments, without for external foot or hand controls.

Some or all of the features recited above can be possible to be performed with the specifically designed weightlifting assistance device according to one or more embodiments of the present disclosure that can use a locking gas spring as the energy storing means (i.e., energy storer), activated via an integrated release pin thereto, with support of one or more linear guides that stiffens the mechanical construction. According to one or more embodiments, the barbell holder, inserted in the movable top, can engage or disengage the release pin, which can render flexible and intuitive use.

Thus, one or more embodiments of the present disclosure can offer a simple and reliable solution that can fully replace an assistant—i.e., the spotter—during weightlifting.

Accordingly, one or more embodiments of the present disclosure can provide or implement a weightlifting assistance device suitable to be mounted on a dedicated squat rack, for instance. The weightlifting assistance device can be formed from or comprise a base, a connector, a movable top, fixation frames, a affixer or coupler for affixing or coupling the weightlifting assistance device to the rack, and a gas spring.

Within the weightlifting assistance device according to one or more embodiments of the present disclosure, one or more linear guide bushings can be locked into the base on one of their sides. Such linear guide bushings can extend parallelly toward the afore mentioned connector, where all guide bushings finally end. Each linear guide, which can emerge from the corresponding liner guide bushing, can have ends connected to the top. Liner guides can allow the top to travel from the connector upward, and for the travel path defined by the used gas spring.

The bottom fixation frame can extend from the base, and the top fixation frame can extend from the connector. Both frames can end into the fixer or coupler, which can be configured to space apart all linear guides from the fixer or coupler.

The top can be equipped with a barbell holder which can allow the barbell holder to be locked within the top at the desired position by using one or more locks.

The gas spring can be selected to be a locking gas spring. The locking gas spring can be formed from the outer cylinder, the piston rod, and the release pin capable to activate a valve mechanism via the force exerted to the release pin. The force can be transmitted via the valve actuator towards the valve that locks or unlocks the locking gas spring.

The gas spring outer cylinder can be nested within the base and the connector in a manner that the piston rod and the socket that is mounted thereto, can be loosely inserted into the top. The release pin, positioned within the piston rod top, can then be in direct mechanical contact with the top and the inserted barbell holder. When an outer force is exerted to the barbell holder in the base direction, such force can unlock previously stored mechanical energy within the locking gas spring and can enable the weightlifting assistance device to produce counterforce by extending the piston rod and movable top with the barbell holder attached thereto in the opposite direction of the applied outer force. Such counterforce can last for all times during which the outer force is exerted, otherwise, in absence of the outer force the locking gas spring can be locked.

In one variant, only one linear guide bushing may be used where the corresponding linear guide can be formed, for instance, as the hollow body nested within the linear guide bushing. The linear guide can travel within the guide bushing. The inner part of the linear guide bushing can be formed to receive the locking gas spring, which can be further fixed to the base and situated centrally within the linear guide bushing. In one sub-variant, the linear guide and the corresponding linear guide bushings can be cylindrical bodies which can be further equipped with one or more rotation preventors which prevent a rotation of the linear guide within the linear guide bushing. In another sub-variant, the one or more rotation preventors can be formed as the guide slit designed longitudinally over the guide. In this solution, the guide slit can cooperate with the connector that partially enters to the slit and prevent the guide rotation and the movable top.

According to one or more embodiments of the present disclosure, two or more linear guide bushings and the corresponding linear guides may be used. The guides can be distributed over the vertices of a regular polygon with n sides, n≥2, where the locking gas spring and its piston rod can be situated at the center of the regular polygon. This geometry can allow a uniform force distribution to the linear guides, which can be connected with the piston rod at the movable top. In one sub-variant, three or four linear guide bushings and the corresponding linear guides may be used with the locking gas spring centrally situated among the linear guides.

According to one or more embodiments, the barbell holder lock can be composed from a plurality (e.g., three) locking bores machined on the barbell holder and the outer locking pin. The locking pin can be inserted through the bore previously formed in the top, and the locking pin can protrude from the desired locking bore and can lock the barbell holder in a desired position within the top. In addition, the fixer or coupler can be parallel with or inclined to the guides which can enable the movable top to travel parallel to the gravitational field. In some variant, the fixer or coupler can have one or more fixation pins dimensioned to enter one or more fixation holes formed on the side frame of the corresponding rack. Such fixer or coupler can be equipped with at least one fixation profile to secure the fixation pins once being nested within the fixation holes. In yet another variant, the fixer or coupler can be fastened to the side frame by using the fixation holes which are capable to receive the bolts. The bolts can be formed from the fixation pins with the threads machined on their ends. The bolts can protrude from the fixation holes and the corresponding nuts, for the bolts can be used for securing the fixer or coupler to the side frame.

The weightlifting assistance device according to one or more embodiments, such as described above, can be used in a pair of identical devices, for instance, situated at the same height from the ground, detachably connected to the dedicated rack. The predetermined force, which may depend on the selected locking gas spring characteristics, exerted on the barbell holders can unlock previously stored mechanical energy within the gas springs. This action can enable the weightlifting assistance devices to produce joint counterforces, i.e., to act as:

- the safety devices preventing the barbell to simply fall on the weightlifter, or
- to help the weightlifter to finish the series of exercises by compensating the part of the weights via the energy stored within the locking gas springs.

FIG. 1 depicts a squat rack 90 with one weightlifting assistance device 10 attached thereto and another 10' that is in the instalment phase, according to one or more embodiments of the present disclosure.

The squat rack can be comprised of the base frame 91, usually made of suitable metal, which enables the athlete to step, or enter, at least partially into the rack space. A plurality of side beams (e.g., several) can define the side frame 92 that emerges from the base frame 91 and ends into the top frame 93. All frames can be made of suitable metals or corresponding alloys. Such construction can render the rack 90 rigid and stable so as to support the weightlifting assistance devices 10, 10' and corresponding lifting weights.

Squat rack side frame 92 can be equipped with holes 99 to which the weightlifting assistant devices 10, 10' can be pinned, via their fixers or couplers 19. The holes 99 can be distributed along the mentioned side frame 92 beams, which can allow the arbitrary height adjustment of one or more weightlifting assistance devices of the pair of weightlifting assistance devices 10, 10' at the frame 92.

Figure 2:
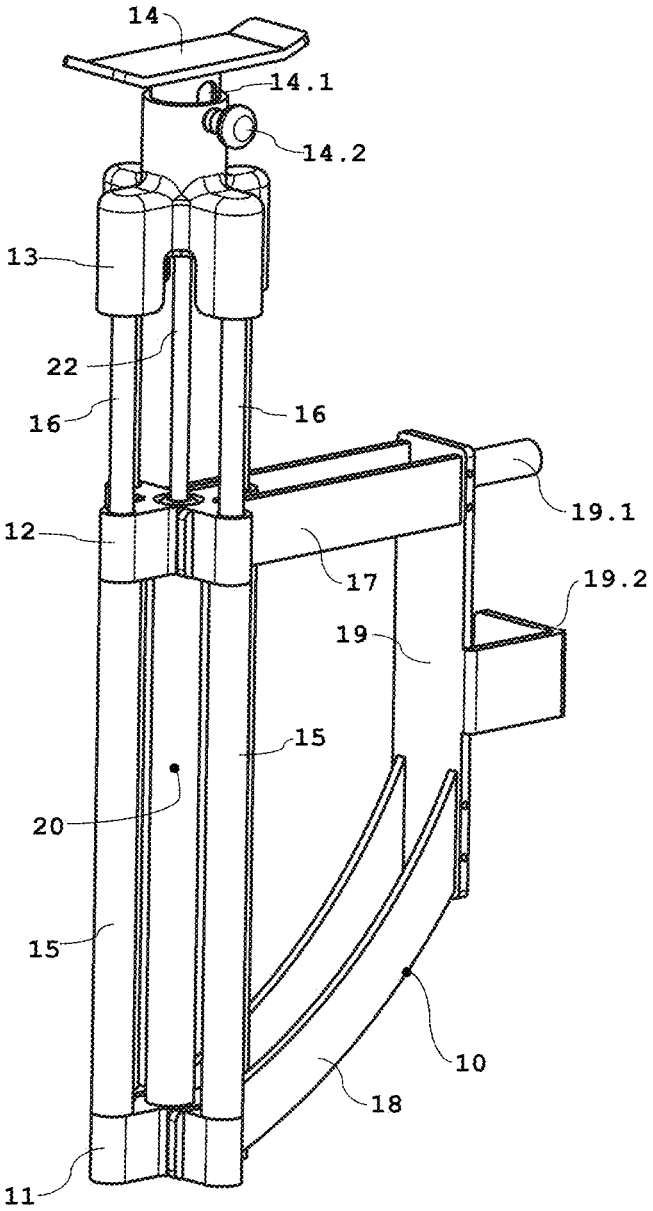
FIG. 2 depicts the weightlifting assistance device according to one or more embodiments of the present disclosure.

Referring now to FIG. 2, the weightlifting assistance device 10 can be comprised of consist of a base 11, a connector 12, and a top 13, which can be movable. A role of the base 11 can be to connect all elements at the bottom of the weightlifting assistance device 10, for instance, for the weightlifting assistance device to operate, i.e., two or more linear guide bushings 15 that can carry the corresponding linear guides 16, the bottom of locking gas spring 20 and the bottom fixation frame 18. Similarly, the connector 12 can connect the same elements on their opposite ends, i.e., the linear guide bushings 15 ends, the top the locking gas spring 20 and the top fixation frame 17. The resulting construction can be regarded as rigid. The base 11 and the connector 12 can be made from suitable metal alloys, e.g., aluminum alloys. Fixation frames 17, 18 end can be connected to the fixer or coupler 19, which can cooperate with the fixation holes 99, formed in the side frame 92 beams. According to one or more embodiments, the fixation pin 19.1 can be dimensioned to enter respective ones of the desired fixation hole 99, while the fixation profile 19.2 can be used for securing the fixation pin 19.1 once nested within the fixation holes 99. In one variant, two or more fixation pins 19.1 can be implemented on one fixer or coupler 19.

In yet another variant, the fixation pins 19.1 can be bolts having threads on their ends. Such bolts can again protrude through the fixation holes 99 and can be fixed to the side frame 92 beam by using adequate nuts.

A role of the fixer or coupler is to space apart all linear guides 16 and other moving/working parts from the side frame 92, and to allow unobstructed functioning of the weightlifting assistance device 10 once attached to the rack 90.

According to one or more embodiments, such as shown in FIG. 2, linear guide bushings 15 can be in the form of hollow cylinders, where corresponding linear guides 16 can be formed as cylinders which diameters are slightly smaller than the corresponding inner linear guide bushing 15 diameters. Each linear guide 16 can travel along the corresponding linear guide bushing 15 almost without friction, and along the main linear guide bushing axis. Optionally, the bushing 15 can be equipped with or otherwise provided relative to a Teflon® ring to prevent lateral movement of the linear guide 16 within the mentioned linear bushing 15 end, situated close to the connector 12.

According to one or more embodiments, two, three, four, or even more identical linear guide bushings 15 can be implemented. Furthermore, one or more embodiments of the present disclosure are not limited with the cross section of the linear guide bushings and the corresponding linear guides used. Linear guide bushings with rectangular cross section can be used equally well, as just one additional example. Also, the various kinds of linear guide bushings can be mixed with cylindrical linear guide bushings, where each linear guide bushing type has its dedicated linear guide, applied on the very same device. Irrespective of the used geometry, the linear guide bushings 15 and the corresponding linear guides 16 can be made from suitable metal alloys.

Figure 4:
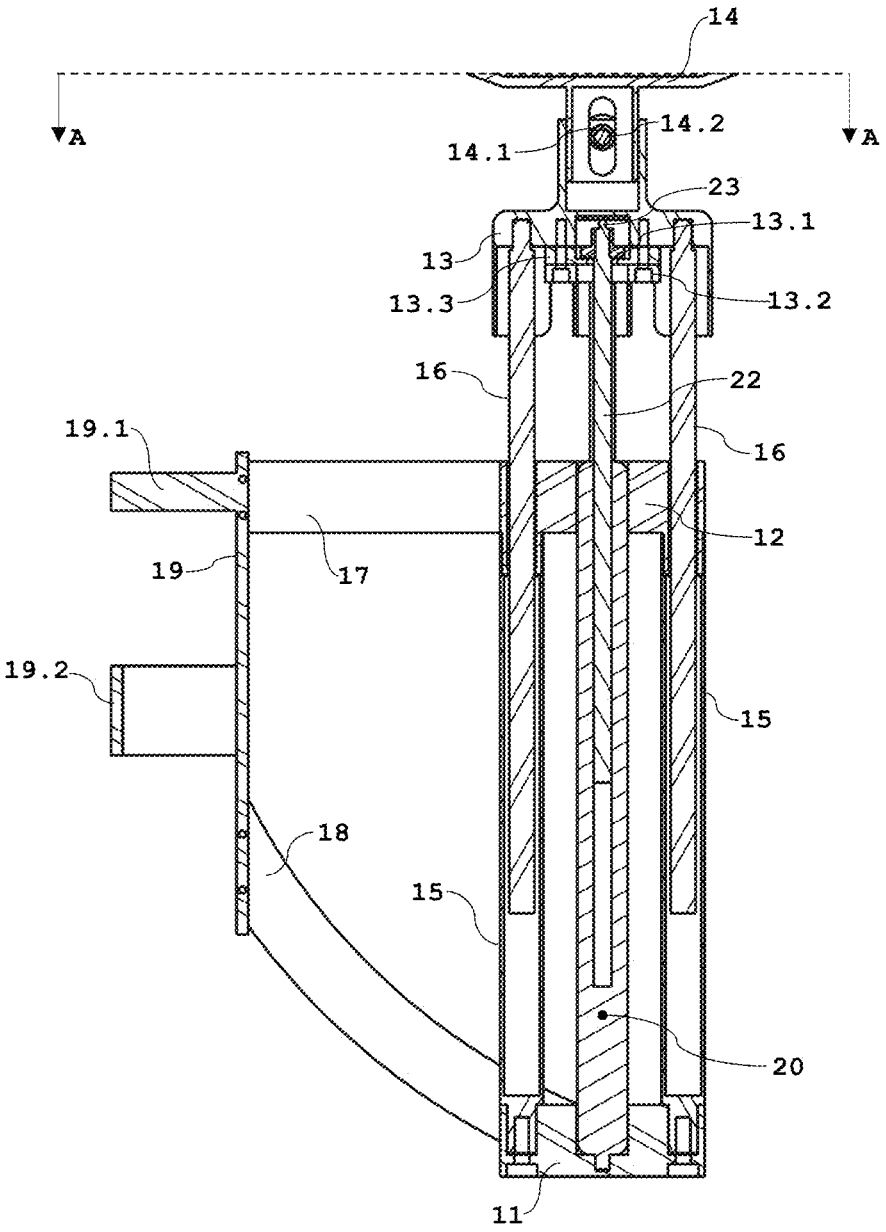
FIG. 4 depicts A-A cross section of the weightlifting assistance device in the position depicted via FIG. 3C.

FIG. 4 depicts the cross-section A-A of the weightlifting assistance device 10, including the way the base 11 connects guide bushings 15 and the corresponding linear guides 16 which are partially pulled out from the linear guide bushings 15 is clearly visible. Furthermore, locking gas spring 20 can be nested within the base 11 and can extend to the connector 12 which connects again the previously recited elements. Two or more linear guide bushings 15 and the corresponding linear guides 16 can be implemented, according to one or more embodiments of the present disclosure, where the linear guides 16 and linear guide bushings 15 can be distributed over the vertices of a regular polygon with n sides, n≥2. The "polygon" with n=2 may be regarded as basically a length with two vertices, n=3 is triangle, etc. According to one or more embodiments, the locking gas spring 20 can be situated at the center of the selected regular polygon, which can allow for a uniform outer force distribution to the linear guides 16, which can be connected with the piston rod 22 at the top 13.

Figure 3A:
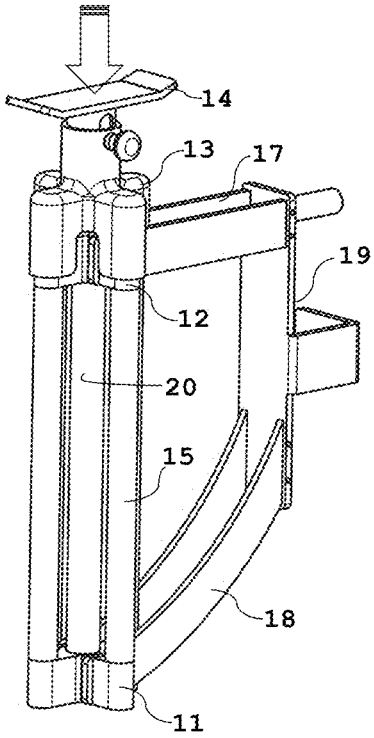
FIG. 3A shows the act of an activation, and the subsequent
Figure 3B:
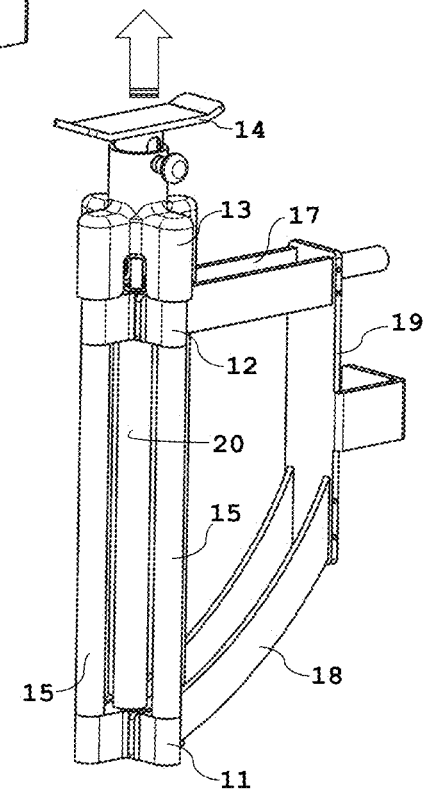
FIGS. 3B and 3C show releasing of the mechanical energy stored into the weightlifting assistance device, that produces counterforce.
Figure 3C:
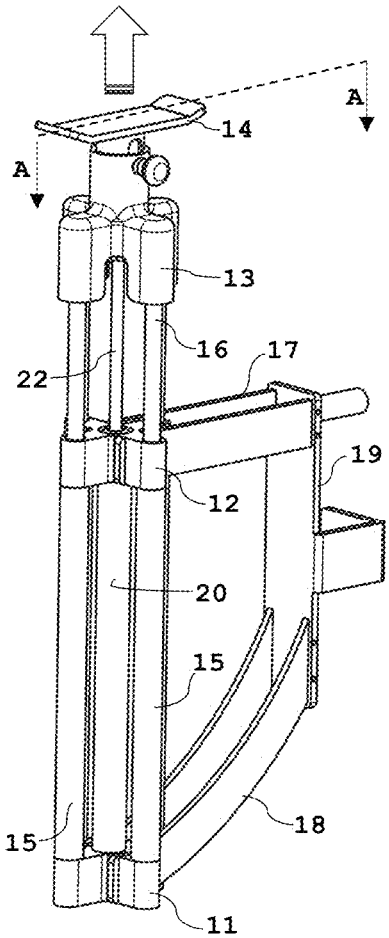

All linear guides 16 and the piston rod 22 of the locking gas spring 20, but not the locking gas spring 20 per se, can be connected to the top 13 in a different way, such as depicted on FIGS. 3B, 3C, and 4.

For instance, the linear guides 16 ends can be connected firmly to the movable top 13. It can be done in a various way, by screwing, by gluing, by welding, or in any other way that is convenient in the art to result with the reliable and solid connection.

On the contrary, the piston rod 22 can be connected somewhat differently. Firstly, the shock absorber 13.2, for instance, made of rubber, and the connection plate 13.3 can be positioned in the way that piston rod 22 protrudes through them. Then the socket 13.1 can be mounted over the end of the piston rod 22. The end of the piston rod 22 can be equipped with the thread. So, in one or more embodiments of the present disclosure, the socket 13.1 can be screwed directly onto the piston rod 22 end, such as shown in FIG. 4. The shock absorber 13.2 and the connection plate 13.3 can be used to loosely connect the said socket 13.1, and the corresponding piston rod 22 end, with the top 13. According to one or more embodiments, screws can connect shock absorber 13.2, and connection plate 13.3 with the top 13. To achieve the above, it is evident that the connection plate 13.2 can be equipped with a nest to receive the socket 13.1. The nest diameter, formed in the connection plate 13.2, can be slightly greater than the socket 13.1 diameter. This construction can allow slight lateral movements of the top 13 and the corresponding nest, relative to the socket 13.1.

The socket 13.1 can have, on its top surface, a bore through which the release pin 23, of the piston rod 22, which can be in permanent contact with the inner surface of the top 13, formed as the horizontal part, for instance, in the form of a plate. Eventually, the additional spring can be inserted between the top of the socket 13.1 and the inner surface of the top 13. This construction can allow the pin 23 to be in permanent contact with the inner surface of the top 13, such as shown in FIG. 4.

Figure 6:
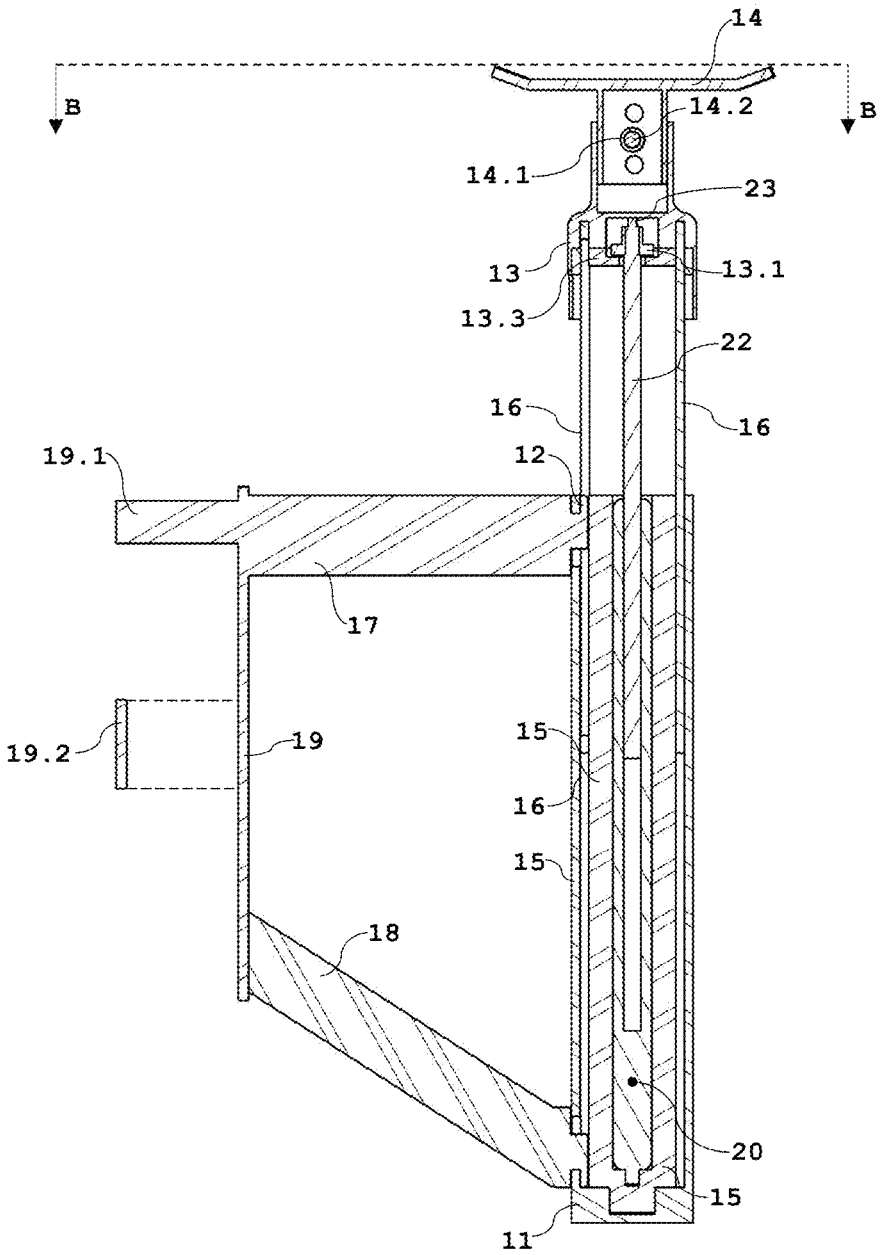
FIG. 6 depicts B-B cross section of the weightlifting assistance device in the position depicted via FIG. 5C.

According to one or more embodiments, the connecting plate 13.3 and shock absorber 13.2 can be integrated into the same element, i.e., formed in or as one piece. Also, according to one or more embodiments, the shock absorber 13.2 may not be implemented, such as shown in FIG. 6.

So, the locking gas spring 20, once activated, can release the mechanical energy stored within it, and can push the piston rod 22 out of the cylinder 21 in a way that the said piston rod 22 lifts the top 13 up. This action can be performed in the way that piston rod 22 acts on the socket 13.1 top surface, nested within the top 13, such as shown FIG. 4. The corresponding linear guides 16 can allow the top 13 to travel along main axes of the linear guides 16 that are formed parallel with the main axis of the piston rod 22. In that way, the linear guides 16 can prevent lateral displacement of the top 13 once being lifted from the connector 12 upward, such as depicted via FIG. 3B and FIG. 3C, via the locking gas spring 20 energy.

The top 13 can be further equipped with the barbell holder 14, where the barbell holder (14) can be fixed within the top 13 at the desired position, such as shown in FIGS. 2 and 4. Barbell holder 14 can be simply inserted and locked into the top 13. A role of barbell holder 14 can be to be in direct contact with the barbell, if necessary, and to transmit the applied outer force to the top 13 and the release pin 23 of the gas cylinder 20.

The barbel holder 14 fixation can be done in many ways. According to one or more embodiments of the present disclosure, fixation can be achieved with one of the locking bores 14.), machined over the barbel holder 14, and the outer locking pin 14.2. The outer locking pin 14.2, once inserted through the bore, previously formed in the top 13 receiving part for the barbell holder 14, can lock securely the barbell holder 14 to the top 13. Namely, the pin 14.2 can protrude the top 13 and the selected locking bore 14.1 and can lock the barbell holder 14 in the desired position within the top 13. The foregoing is just one example, and other fixation system may be implemented. For instance, such fixation can be achieved with a fixation screw that can be inserted through the bore formed on the top 13 in order to fix the barbell holder 14 within the top 13 at the desired position. A technical role of the fixer or coupler 19 can be to allow a precise tuning of the barbell holder position 14 within the top 13, and to prevent the barbel holder 14 rotation within the top 13.

Another embodiment of the present disclosure is shown in FIGS. 5A, 5B, 5C, 5D, and 6. This embodiment may be regarded as differing from the above-discussed embodiment (s) in the fact that only one linear guide 16, with the corresponding guide bushing 15 may be used. In practice, one hollow cylindrical linear guide bushing 15 can form the outer part of the device 10 and the inner part of the device 10 wherein the gas cylinder 20 can be nested. The corresponding linear guide 16, such as shown in FIG. 6, can be formed as a hollow cylinder nested within the cylindrical linear guide bushing 15. The linear guide 16 can be capable to travel within the cylindrical linear guide bushing 15 with minimal friction and without rotation. Basically, system 15, 16 can be formed as three concentrically hollow cylinders, two cylinders can form the linear guide bushing 15, outer and inner, and a centrally positioned hollow cylinder can form a linear guide. In practice other geometries can also be used, e.g., the hollow guides with rectangular cross section or similar cross section. In all solutions and variants the used locking gas spring 20 can be fixed to the base 11 and situated centrally to the inner part of the linear guide bushing 15 regardless the used geometry.

In case of cylindrical geometry, one or more rotation preventers can be implemented to prevent a rotation of the guide 16 within the linear guide bushing 15. To prevent the rotation, the guide slit 16.1, for instance, as the rotation preventer or part of the rotation preventer can be formed longitudinally over the guide 16, such as depicted on FIG. 5D. The guide slit 16.1 can cooperate with the connector 12 that can partially enter to the slit 16.1 and can prevent the guide 16 rotation, such as depicted in FIG. 6. The prevention of rotation may assure that the barbell holder 14 is correctly positioned below the barbell.

The rest of the weightlifting assistance device 10, i.e., the top 13), the corresponding socket 13.1 where the piston rod 22 is nested, the barbell holder 14 and its corresponding fixer or coupler 19 can be the same as described earlier. A role of the fixation frames 17, 18 and the fixer or coupler 19 can be the same as described above.

Figure 7:
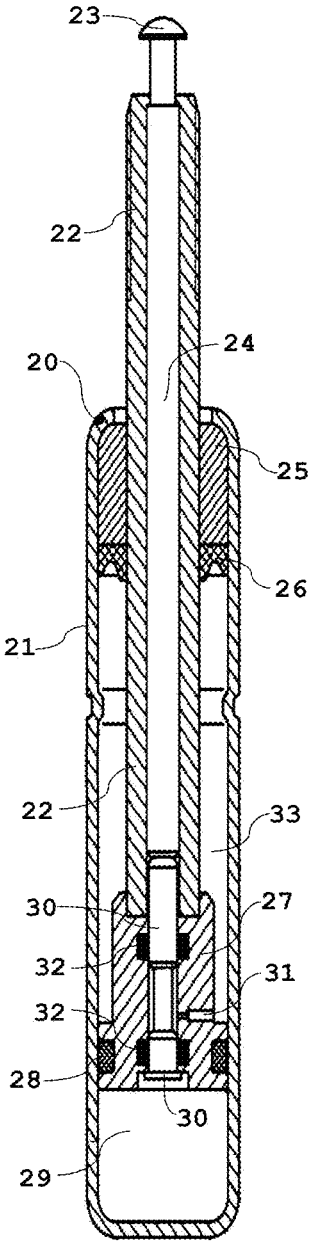
FIG. 7 depicts a locking gas spring, which may be used within the weightlifting assistance device according to one or more embodiments of the present disclosure.
Figure 8A:
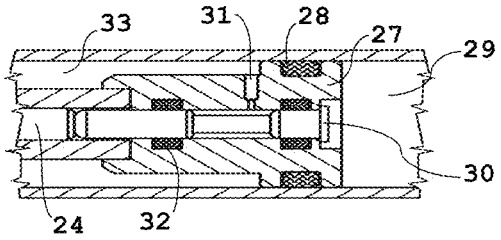
FIG. 8A depicts the closed valve situation when the gas spring is locked, and FIG. 8B open valve situation when the gas spring is activated.
Figure 8B:
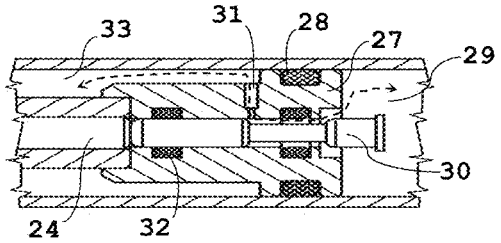

The locking gas cylinder 20, which can enable all the weightlifting assistance device 10 features are described now with respect to FIGS. 7, 8A and 8B. FIG. 7 select (e.g., some or all) components of the locking gas cylinder 20. According to one or more embodiments, the locking gas cylinder 20 can comprise of outer cylinder 21 that can be regarded as forming a main body. The movable part can be the piston rod 22, that can be connected with the piston 27 situated within the outer cylinder 21, and which can be appropriately sealed with the piston seal 28. The piston 27 can divide outer cylinder spacing into two parts; below is situated the first chamber 29, and the above piston 27 can be the second chamber. The chambers 27, 29 can communicate across the valve 30 which can be situated within the piston 27. The valve 30 can be sealed to the piston 27 with the pair valve seals 32 in a way to prevent the gas leakage out of the cylinder 21, across the valve 30, during the cylinder 20 operations.

The front inner part of the outer cylinder 21 can be equipped with the guide 25 to guide the piston rod 22, and additionally sealed with the seal 26 that can prevent gas leakage from the second chamber 33. At the very end of the piston rod 22, a release pin 23 can be formed. This release pin 23 can be pushed towards the piston rod 22 interior, where it can push valve activator 24 that acts to the valve 30. An example of a situation when the release pin 23 is out from the piston rod 22 is depicted on FIG. 8A, and the valve 30 is closed. An example of a situation when the release pin 23 is pushed towards the piston rod 22 is depicted on FIG. 8B, and the valve 30 is then open.

Regarding operation of the gas spring, basically, the difference in the piston 27 area which can be oriented towards the second chamber 33 and the piston 27 area that is oriented towards the first chamber 29 may not be the same. The fluid, e.g., highly compressed nitrogen gas within the cylinder can create force on each side of the piston 27. The force can be regarded as Force=Area×Pressure, and smaller area can mean the smaller force exerted to the piston 2). So, even when the pressure in the first chamber 29 is equal with the pressure within the second chamber 33—i.e., when the valve 30 is open—the net force on the piston 27 still exists due to the area differences. The net force can push the piston 27 upwards, towards the guide 25. According to one or more embodiments, the net force may be almost constant over all piston 27 positions through the outer cylinder 21.

For pushing the piston 27 downwards, the outer force, i.e., external work, can be applied over the traveled path, and the valve 30 can be opened, i.e., the release pin 23 can be pressed. This is the way the gas cylinder 20 can accumulate mechanical energy and release it, if necessary, in a reverse process.

The locking ability can be achieved once the valve 30 is closed. The closed valve 30 can create the equilibrium process to occur, i.e., that the first chamber 29 pressure multiplied with the corresponding piston 27 area is equal with the second chamber pressure 33 multiplied with the piston 27 area oriented towards the chamber. The equilibrium can be very quickly reached, for instance, if the compressed gas pressures are rather high.

Figure 5A:
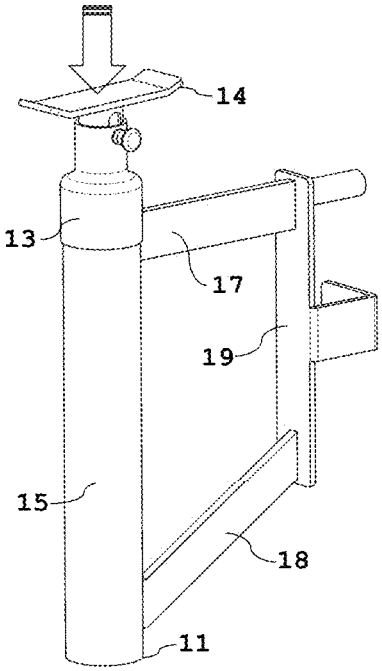
FIGS. 5A, 5B, 5C, and 5D depict the weightlifting assistance device according to another embodiment, where
Figure 5B:
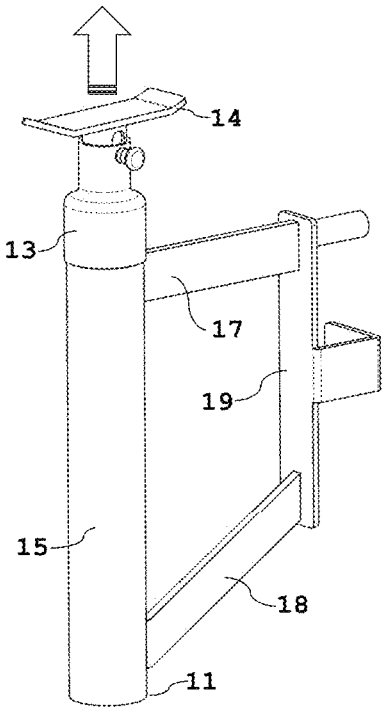
Figure 5C:
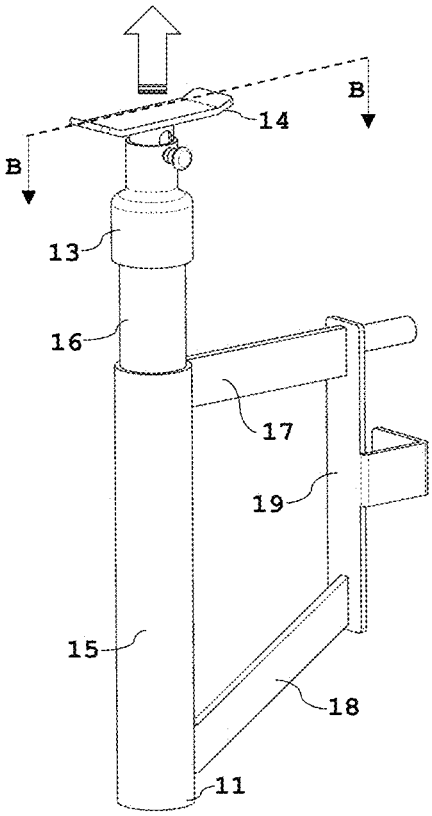
Figure 5D:
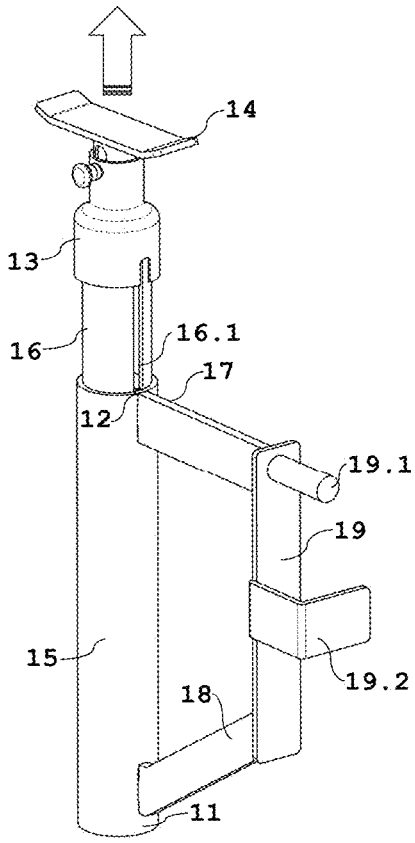

A working mode can be independent of the used embodiment. That is, all embodiments of the present disclosure may operate the same, generally speaking. FIGS. 3A and 5A show exemplary activation of the weightlifting assistance device 10 according to one or more embodiments of the present disclosure. Down pressing the barbell holder 14, can push the top 13 in the base direction 11. This action can cause the corresponding one or more guides 16 attached to the top 13 to move toward the base 11, and the release pin 23 can also be pressed into the piston rod 22, which can be situated within the socket 13.1. Afterward, the valve 30 can be activated within the locking gas cylinder 20. This action can activate the locking gas spring 20 and result with the opposite counter force all the way the release pin 23 is pressed into the piston rod 22, such as shown in FIGS. 3B, 3C, 5B, and 5C. The top 13, and the corresponding barbell holder 14, can elevate from the weightlifting assistance device 10, locked to the side frame 92, using the mechanical energy previously stored within the locking gas cylinder 20.

According to one or more embodiments, as noted above, a pair of weightlifting assistance devices 10, 10' can be implemented, such as depicted on the FIG. 1. If the weightlifter experienced an unexpected event during the weight lifting, the whole barbell with the weights may press both barbell holders 14, 14' of the weightlifting assistance devices 10, 10'. Then, the energy from the locking gas springs 20, 20' (e.g., all of the energy) can be released in order to help the weightlifter to remove the barbell with the weights, by taking part of the weight which the weightlifter experiences, producing the opposite force to the barbell gravity force.

In another example, it can be possible to help the weightlifter to finish the series of exercises by compensating for part of the weight via the energy stored within the locking gas springs 20, 20'. Namely, the weightlifter can let the barbell press the barbell holders 14, 14' during the exercise. This can produce the counterforce upward from the weightlifting assistance devices 10, 10' which can help the weightlifter to lifts the weights. If the weightlifter decides to make more than one repetition, that it will simply let the barbell to press weightlifting assistance devices 10, 10' downwards. Then, the weight will partially produce the necessary outer work for storing the energy into the locking gas springs 20, 20'. When the weightlifter starts again to lift the barbell with the weight, this energy will be released, for instance, in a constant manner, all the way the release pins 23, 23' are pressed into the corresponding piston rods 22, 22'.

When the weightlifter finishes the exercise, the weightlifting assistance devices 10, 10' may have to be re-activated. Such reactivation can be performed in the way that each weightlifting assistance device 10, 10' can be firstly pressed manually downwards by pressing the barbell holder 14 towards the base 11. This action can cause all line guides 16 to retract in the corresponding line bushings 15, and the gas cylinder rod 22 can come to its lowest position. Then, a manual pushing force can be abruptly removed from the barbell holder 14, which can cause the locking gas cylinder 20 to be locked in this position, e.g., a lowest position. Then, the entire weightlifting assistance device 10 can be again ready to be used in any of the above cited examples, considering the fact that outer work stored operational mechanical energy into the weightlifting assistance device 10.

In the above-described way, the pair of weightlifting assistance devices 10, 10' can be used as the assistance device, in a manner similar the spotter do.

It is also possible to control the efficiency of the used gas springs 20, 20', i.e., the produced weightlifting assistance devices 10, 10' counterforces—by adding the additional weights to their tops 13, 13'. In that sense, it can be possible to lower the net counterforces produced by the gas springs 20, 20' for different exercises, if needed. One way to perform the desired task can be to add extra weights, in the form of weight rings, for instance, that can be attached to the tops 13, 13'.

INDUSTRIAL APPLICABILITY

Embodiments of the present disclosure can involve or be directed to one or more improved weightlifting assistance devices, with safety feature implemented to the same weightlifting assistance device. Used in a pair, for instance, the weightlifting assistance devices according to one or more embodiments of the present disclosure can prevent the barbell to squeeze the weightlifter and/or can help the weightlifter to finish a series of exercises, compensating part of the weights force.

The invention claimed is:

1. A weightlifting assistance device configured to be mounted on a rack, comprising:

a base, a connector, a top configured to be movable, fixation frames, a coupler to removably couple the weightlifting assistance device to the rack, and a gas spring, wherein one or more linear guide bushings are locked into the base on one side, and extend parallelly toward the connector, where all guide bushings end;

each linear guide, which emerges from the corresponding liner guide bushing, ends connected to the top, allowing the top to travel from the connector upward for a travel path defined by the gas spring;

a bottom fixation frame of said fixation frames extends from the base and the top fixation frame extends from the connector, where both the bottom and top fixation frames end into the coupler and space apart all linear guides from the coupler, where the top is equipped with a barbell holder, allowing the barbell holder to be locked within the top at a desired position by using a lock;

the gas spring is a locking gas spring that is formed from an outer cylinder, a piston rod, and a release pin configured to activate a valve mechanism via force exerted to the release pin, and the force being transmitted via a valve actuator towards the valve to lock or unlock the locking gas spring;

the outer cylinder of the gas spring is nested within the base and the connector in a manner that the piston rod and a socket mounted to the piston rod, are loosely inserted into the top in a way that the release pin, positioned within the piston rod top, is in direct mechanical contact with the top and the barbell holder inserted thereinto; and under a condition that the outer force is exerted to the barbell holder in the base direction, the outer force unlocks previously stored mechanical energy within the locking gas spring and enables the weightlifting assistance device to produce counterforce by extending the piston rod and the top with the barbell holder attached thereto in the opposite direction of the applied outer force for times during which the outer force is exerted, otherwise in absence of the outer force the locking gas spring is locked.

2. The weightlifting assistance device according to claim 1, wherein only one linear guide bushing is used, and where the corresponding linear guide is formed as a hollow body nested within the bushing and configured to travel within the guide bushing, where the inner part of the linear guide bushing is formed to receive the locking gas spring which is further fixed to the base and situated centrally within the linear guide bushing.

3. The weightlifting assistance device according to claim 2, wherein the linear guide and the corresponding linear guide bushings are cylindrical bodies, that are further equipped with one or more rotation preventers to prevent a rotation of the linear guide within the linear guide bushing.

4. The weightlifting assistance device according to claim 3, wherein the rotation preventer is a guide slit formed longitudinally over the linear guide, where the guide slit cooperates with the connector that partially enters to the guide slit to prevent the rotation of the linear guide and the rotation of the top.

5. The weightlifting assistance device according to claim 1, wherein two or more linear guide bushings and the corresponding linear guides are used, and where the linear guides are distributed over the vertices of a regular polygon with n sides, $n \geq 2$, where the locking gas spring and its piston rod are situated at the center of the regular polygon, allowing a uniform force distribution to the linear guides which are connected with the piston rod at the top.

6. The weightlifting assistance device according to claim 5, wherein three or four cylindrical linear guide bushings and the corresponding linear guides are used with the locking gas spring centrally situated among the linear guides.

7. The weightlifting assistance device according to claim 1, wherein the barbell holder lock is composed from a plurality of locking bores machined on the barbell holder and an outer locking pin, where the locking pin is insertable through the bore formed in the top and which protrudes the desired locking bore and locks the barbell holder in a desired position within the top.

8. The weightlifting assistance device according to claim 1, wherein the coupler is parallel with or inclined to the linear guides such that the top travels parallel to the gravitational field.

9. The weightlifting assistance device according to claim 8, wherein the coupler is/are formed with one or more fixation pins dimensioned to enter respective one or more fixation holes formed on a side frame of the rack, and where the coupler is equipped with at least one fixation profile for securing the fixation pins nested within the fixation holes.

10. The weightlifting assistance device according to claim 8, wherein the coupler is fastenable to the side frame, using the fixation holes which are configured to receive the bolts, where bolts are formed from the fixation pins with the threads machined on their ends, where the bolts protrude from the fixation holes and the corresponding nuts for the bolts secure the coupler to the side frame.

11. The use of the weightlifting assistance device according to claim 1, as a pair of identical said weightlifting assistance devices situated at a same height from the ground and detachably connected to the rack.

12. The use of the weightlifting assistance devices according to claim 11, where the predetermined force, which depends on selected locking gas spring characteristics, exerted on the barbell holders unlocks previously stored mechanical energy within the gas springs and enables the assistance devices to produce joint counterforces and to act as:

the weightlifting safety devices preventing the barbell to fall on the weightlifter, and/or to help the weightlifter to finish a series of exercises by compensating part of the weight via the energy stored within the locking gas springs.

13. A weightlifting system comprising:

a first weightlifting assistance device; and a second weightlifting assistance device, wherein each of the first and second weightlifting assistance devices includes:

a base, a connector, a top configured to be movable, a plurality of fixation frames, a fixer to removably affix the weightlifting assistance device to a rack, and a spring, wherein one or more linear guide bushings are locked into the base on one side, and extend parallelly toward the connector;

each linear guide, which emerges from the corresponding liner guide bushing, ends connected to the top, allowing the top to travel from the connector upward for a travel path forced by the spring;

a bottom fixation frame of the plurality of fixation frames extends from the base and the top fixation frame extends from the connector, where both the bottom and top fixation frames end into the coupler and space apart all linear guides from the coupler, where the top is equipped with a barbell holder, allowing the barbell holder to be locked within the top at a desired position by using a lock;

the spring is a locking spring that is formed from an outer cylinder, a piston rod, and a release pin configured to activate a valve mechanism via force exerted to the release pin, and the force being transmitted via a valve actuator towards the valve to lock or unlock the locking spring;

the outer cylinder of the locking spring is nested within the base and the connector in a manner that the piston rod and a socket mounted to the piston rod, are loosely inserted into the top in a way that the release pin, positioned within the piston rod top, is in direct mechanical contact with the top and the barbell holder inserted thereinto; and under a condition that the outer force is exerted to the barbell holder in the base direction, the outer force unlocks previously stored mechanical energy within the locking spring and enables the weightlifting assistance device to produce counterforce by extending the piston rod and the top with the barbell holder attached thereto in the opposite direction of the applied outer force for times during which the outer force is exerted, otherwise in absence of the outer force the locking spring is locked.

14. The weightlifting assistance device according to claim 13, wherein only one linear guide bushing is used, and where the corresponding linear guide is formed as a hollow body nested within the bushing and configured to travel within the guide bushing, where the inner part of the linear guide bushing is formed to receive the locking spring which is further fixed to the base and situated centrally within the linear guide bushing.

15. The weightlifting assistance device according to claim 14, wherein the linear guide and the corresponding linear guide bushings are cylindrical bodies, that are further equipped with one or more rotation preventers to prevent a rotation of the linear guide within the linear guide bushing, and each of the rotation preventers includes a guide slit formed longitudinally over the linear guide, where the guide slit cooperates with the connector that partially enters to the guide slit to prevent the rotation of the linear guide and the rotation of the top.

16. The weightlifting assistance device according to claim 13, wherein two or more linear guide bushings and the corresponding linear guides are used, and where the linear guides are distributed over the vertices of a regular polygon with n sides, $n \geq 2$, where the locking spring and its piston rod are situated at the center of the regular polygon.

17. The weightlifting assistance device according to claim 13, wherein the barbell holder lock is composed from a plurality of locking bores on the barbell holder and an outer locking pin, where the locking pin is insertable through the bore formed in the top and which protrudes the desired locking bore and locks the barbell holder in a desired position within the top.

18. The weightlifting assistance device according to claim 13, wherein the fixer is parallel with or inclined to the linear guides such that the top travels parallel to the gravitational field.

19. The weightlifting assistance device according to claim 18, wherein the fixer has one or more fixation pins dimensioned to enter respective one or more fixation holes formed on a side frame of the rack, and where the fixer is equipped with at least one fixation profile for securing the fixation pins nested within the fixation holes.

20. The weightlifting assistance device according to claim 18, wherein the fixer is fastenable to the side frame, using the fixation holes which are configured to receive the bolts, where bolts are formed from the fixation pins with the threads on their ends, where the bolts protrude from the fixation holes and the corresponding nuts for the bolts secure the fixer to the side frame.

* * * * *